US005549958A

United States Patent [19]

Royaerts

[11] Patent Number: 5,549,958

[45] Date of Patent: Aug. 27, 1996

[54] COMPOSITE MATERIAL FOR THE MANUFACTURE OF SEATS, SEAT BACKS AND LIKE OBJECTS COMPRISING A DIFFERENTIALLY WOVEN FABRIC OF WARP THREADS AND WEFT WIRES

[75] Inventor: Didier Royaerts, F 09600, Regat, France

[73] Assignees: Didier Royaerts, Regat; Societe Duret, Brionne, both of France

[21] Appl. No.: 374,098

[22] Filed: Jan. 18, 1995

[30] Foreign Application Priority Data

Jan. 28, 1994 [FR] France ..... 94 00976

[51] Int. Cl.[6] ..... B32B 3/02; B32B 5/02; B32B 7/00

[52] U.S. Cl. ..... 428/95; 428/229; 428/233; 428/236; 428/257; 428/259

[58] Field of Search ..... 428/257, 259, 428/229, 233, 237, 236, 95

[56] References Cited

U.S. PATENT DOCUMENTS 4,887,656 12/1989 Verbauwhede et al. ..... 152/531
5,393,595 2/1995 Rousset et al. .

FOREIGN PATENT DOCUMENTS 0529671 3/1993 European Pat. Off. .
2592334 7/1987 France .
3711837 2/1988 Germany .

*Primary Examiner*—James Withers
*Attorney, Agent, or Firm*—Greenblum & Bernstein P.L.C.

[57] ABSTRACT

A composite material for the manufacture of seats, seat backs and like objects receives a decorative fabric on one side, the other side cooperating with the frame or stuffing of the seat. The composite material is woven and includes a metal armature with warp threads and weft wires. The weft wires are steel rods bent to a shape having regular undulations and disposed so that the undulations are parallel and coplanar. The warp threads are interwoven with the rods, at least part of the armature being embedded in an elastomer.

12 Claims, 2 Drawing Sheets

COMPOSITE MATERIAL FOR THE MANUFACTURE OF SEATS, SEAT BACKS AND LIKE OBJECTS COMPRISING A DIFFERENTIALLY WOVEN FABRIC OF WARP THREADS AND WEFT WIRES

BACKGROUND OF THE INVENTION

1. Field of the invention

The present invention relates to a new composite material for the manufacture of seats, seat backs, benches, etc more particularly intended for use in public places and railroad cars.

2. Description of the prior art

Seats in public places and on railroad cars are very often vandalized, being slashed with sharp objects.

To counter such vandalism seats have been made with a kind of metal armature between the covering fabric and the interior stuffing or frame. In one prior art implementation a kind of metal grill is partially embedded in silicone rubber to one side of which the covering fabric is glued.

This has proved effective but the resulting seat is relatively rigid and consequently very uncomfortable.

One object of the present invention is to provide a composite material adapted to receive a decorative fabric on one side and whose other side cooperates with the stuffing or frame of the seat, the composite material being resistant to slashing and seats manufactured using it being much more comfortable than prior art seats.

SUMMARY OF THE INVENTION

The invention consists in a composite material for the manufacture of seats backs and like objects adapted to receive a decorative fabric on one side, the other side cooperating with the frame or stuffing of said seat, said composite material being woven and including a metal armature with warp threads and weft wires, wherein said weft wires are steel rods bent to a shape having regular undulations, said rods are disposed so that said undulations are parallel and coplanar, said warp threads are interwoven with said rods, and at least part of said armature is embedded in an elastomer.

The warp threads are preferably made from a material allowing sliding of the rods, for example polyamide, and have a diameter between 0.14 mm and 0.60 mm.

The steel rods preferably have a diameter between 0.5 mm and 1.2 mm.

In accordance with another feature of the invention, there are between 300 and 500 steel rods per meter and between 500 and 2,000 warp threads per square meter.

One side of the composite material is preferably attached to a fabric, which can be a cotton or a polyester fabric.

To increase the flexibility of the composite material and to facilitate the adhesion of an injected foam forming the stuffing of the seat, the fabric can have loops on the side opposite the armature.

The invention will now be described in more detail by way of example only and with reference to a specific embodiment of the invention shown in the appended drawings.

DETAILED DESCRIPTION OF THE PREFERRED EMBODIMENT

Rods 1, preferably made of steel, having a diameter between 0.5 mm and 1.2 mm are used to manufacture the composite material. These rods are coated to resist rust and can be made from mild steel with a greater or lesser carbon content. Each rod 1 is bent to a shape comprising regular undulations 2*a* and 2*b*.

The rods are interwoven with warp threads 3 which are preferably made from a material allowing slipping of the rods 1, for example a single-strand polyamide with a diameter between 0.14 mm and 0.60 mm. This ensures that during interweaving the weft rods 1 are perfectly parallel and that the undulations are in a common plane.

Figure 1:
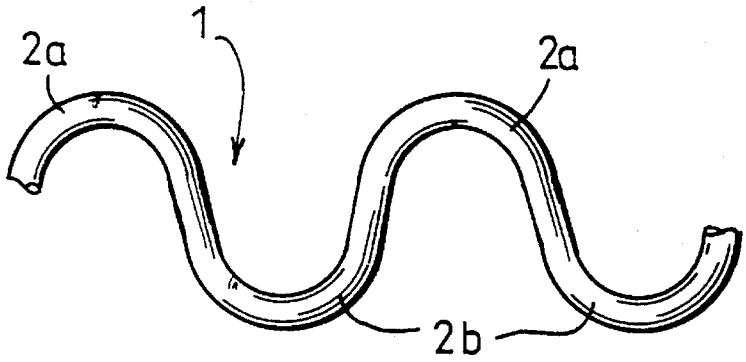
FIG. 1 shows a warp rod in perspective.
Figure 2:
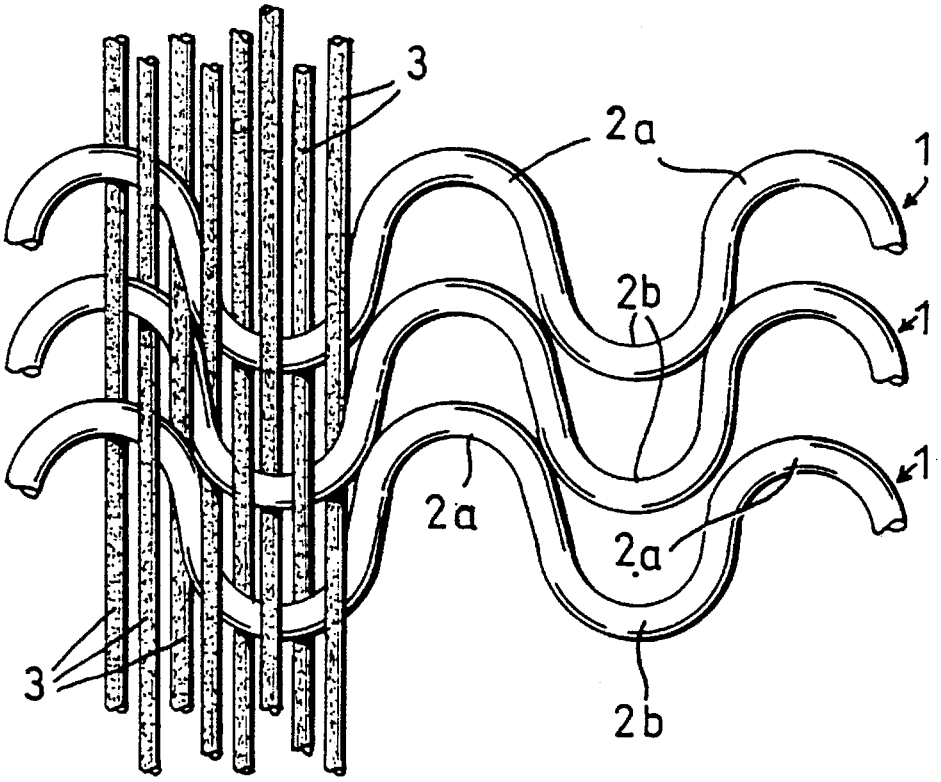
FIG. 2 is a plan view of part of the composite material of the invention.

The warp threads 3 are interwoven with, i.e. pass alternately over and under the weft rods, in the usual manner; where one warp wire 3 passes over a rod 1 the next thread passes under the same rod, and so on (see FIG. 2).

The warp threads cover substantially all of the weft and there can be between 500 and 2,000 of them per square meter. There can be between 300 and 500 undulating rods per meter.

Figure 3:
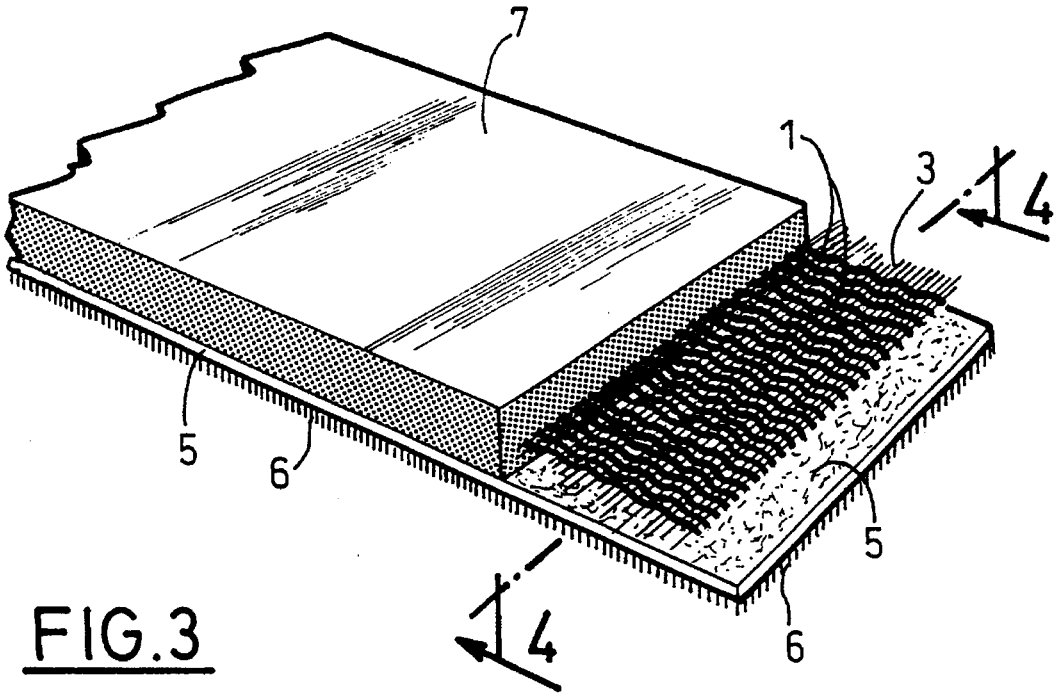
FIG. 3 is a perspective view showing the composite material during manufacture.
Figure 4:
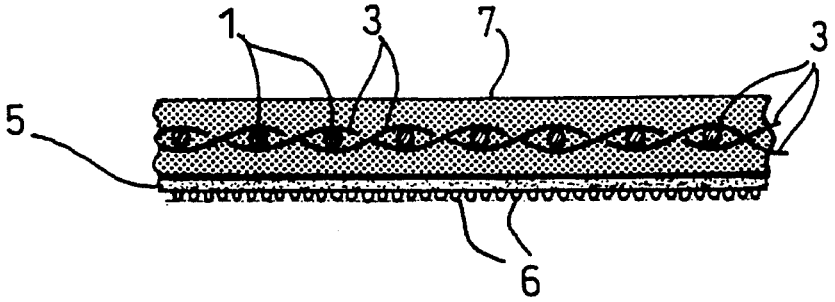
FIG. 4 is a view in section on the line 4—4 in FIG. 3 and to a larger scale.

The resulting armature is embedded in an elastomer 7, preferably a fireproof silicone rubber which can set hot or cold (see FIG. 3).

A fabric 5 can be fixed to one side, this fabric adhering to the elastomer 7.

If the seat is to be stuffed, for example with foam, the fabric 5 can have loops 6 on the side opposite the armature to facilitate bonding of the foam and the composite material.

If the seat has a frame rather than stuffing, the fabric 5 can be different, for example cotton canvas.

The finished composite material can have a thickness in the order of 2.5 mm to 3.5 mm, so that it is flexible, the elastomer side 7 having a decorative fabric such as velvet glued to it.

Many tests have shown that because of the undulations in the metal rods 1 slashing with sharp objects in either direction or transversely does not damage the composite material and that it is virtually impossible to pierce the composite material with a "dagger blow".

Of course, the invention is not limited to the embodiment described and shown. Many modifications of detail can be made thereto without departing from the scope of the invention.

There is claimed:

1. Composite material for the manufacture of seats, seat backs and like objects adapted to receive a decorative fabric on one side, the other side cooperating with the frame or stuffing of said seat, said composite material being woven and including a metal armature with warp threads and weft wires, wherein said weft wires are steel rods bent to a shape having regular undulations, said rods are disposed so that said undulations are parallel and coplanar, said warp threads are interwoven with said rods, and at least part of said armature is embedded in an elastomer.

2. Composite material according to claim 1 wherein said warp threads are made of polyamide.

3. Composite material according to claim 1 wherein said warp threads have a diameter between 0.14 mm and 0.60 mm.

4. Composite material according to claim 1 wherein said steel rods have a diameter between 0.5 mm and 1.2 mm.

5. Composite material according to claim 1 comprising between 300 and 500 steel rods per meter and between 500 and 2,000 warp threads per square meter.

6. Composite material according to claim 1 wherein one side is attached to a fabric.

7. Composite material according to claim 6 wherein said fabric is a cotton fabric.

8. Composite material according to claim 6 wherein said fabric has loops on one side.

9. Composite material according to claim 8 wherein said fabric is a polyester fabric and said loops are on the side opposite said armature.

10. A composite material for use in the manufacture of seats, seat backs, and the like, said composite material including a first and second surface, said first surface for receiving a fabric and said second surface for coupling to a seat frame, said composite material comprising:

a plurality of weft wires arranged in a first direction;

a plurality of warp threads arranged in a second direction substantially perpendicular to said first direction, said warp threads intertwining said plurality of weft wires;

each of said plurality of weft wires comprising a substantially sinusoidal shape and said plurality of weft wires being coplanarly arranged in parallel; and an armature formed by the intertwining of the weft wires with the warp threads, at least a portion of said armature being embedded in an elastomer.

11. The composite material according to claim 10, each of said plurality of weft wires comprising a steel rod.

12. The composite material according to claim 10, wherein said plurality of weft wires are arranged to be in phase.

* * * * *